United States Patent [19]

Wallow

[11] Patent Number: 4,603,636

[45] Date of Patent: Aug. 5, 1986

[54] FORM-LOCKING ARRANGEMENT FOR PROJECTILES

[75] Inventor: Peter Wallow, Düsseldorf, Fed. Rep. of Germany

[73] Assignee: Rheinmetall GmbH, Düsseldorf, Fed. Rep. of Germany

[21] Appl. No.: 632,434

[22] Filed: Jul. 19, 1984

[30] Foreign Application Priority Data

Jul. 20, 1983 [DE] Fed. Rep. of Germany ..... 3326131

[51] Int. Cl.[4] ..... F42B 13/16

[52] U.S. Cl. ..... 102/521; 29/1.23; 29/456

[58] Field of Search ..... 102/520, 521, 522, 523, 102/524, 525, 526, 527, 528; 29/433, 456, 457, 1.2, 1.23

[56] References Cited

U.S. PATENT DOCUMENTS

| | | | |
|---|---|---|---|
| 2,996,011 | 8/1961 | Dunlap | 102/521 |
| 3,262,391 | 7/1966 | Shober | 102/521 |
| 3,745,926 | 7/1973 | Mertz et al. | 102/523 |
| 3,859,922 | 1/1975 | Kaplan et al. | 102/521 |
| 4,187,783 | 2/1980 | Campoli | 102/520 |
| 4,360,954 | 11/1982 | Burns et al. | 29/1.23 |
| 4,469,027 | 9/1984 | Burns et al. | 102/521 |

FOREIGN PATENT DOCUMENTS

| | | |
|---|---|---|
| 3104745 | 4/1984 | Fed. Rep. of Germany . |
| 495501 | 10/1919 | France . |
| 2523715 | 9/1983 | France . |

*Primary Examiner*—David H. Brown
*Assistant Examiner*—Michael Carone
*Attorney, Agent, or Firm*—Karl F. Ross; Herbert Dubno

[57] ABSTRACT

A form-locking device for holding a sabot on a projectile body of a subcaliber inertial projectile consists of a metal strip round overlapping turns or endless metal rings in overlapping relationship formed on said body preferably with hot or cold working and previously provided with an outwardly open groove or formed with an outwardly working groove during the working operation to receive complementary ridge or projection of the sabot. The system avoids notching of the projectile body and lessening of the penetrability of the projectile.

18 Claims, 10 Drawing Figures

FORM-LOCKING ARRANGEMENT FOR PROJECTILES

FIELD OF THE INVENTION

My present invention relates to a form-locking arrangement for a projectile and, more particularly, to a projectile of a subcaliber type in which a sabot is affixed in a form-locking manner to the exterior of the body of the projectile, preferably a heavy-metal inertial projectile, designed primarily to penetrate amor (e.g. multilayer armor). The invention is thus also concerned with such projectile assemblies including the sabot and the projectile body.

BACKGROUND OF THE INVENTION

A subcaliber projectile is a projectile whose body is smaller in diameter than the bore of the weapon, e.g. a cannon from which the projectile is to be fired. While the body of the projectile may be armed, i.e. include an explosive charge, considerable attention has been directed in recent years to inertial impact projectiles which are composed of a heavy metal and, in even more recent developments, may comprise several parts for successively penetrating the layers of armor of armored vehicles such as tanks and personnel carriers. The body is thus composed of or comprises a heavy metal, e.g. titanium, or composites of heavy metals.

Such bodies may be fin-stabilized, i.e. provided with fins which stabilize the flight of the projectiles as the projectile initially emerges from the weapon and following the separation of the sabot segments from the projectile body.

The sabot is in effect a self-releasing adapter between the relatively slender body of the projectile and the wall of the bore of the weapon so that the gases generated by the firing of a charge in the breech of the weapon will propel the projectile assembly from the mouth of the barrel along the desired trajectory. During flight, upon encountering air resistance, the segments of the sabot may be pulled away from their form-locking engagement with the body of the projectile and thus are lost as the fin-stabilized body continues on its flight to the target. The sabot is frequently also referred to as a drive cage.

Reference may be had to U.S. patent application Ser. No. 291,825 corresponding to German application DE-P 30 30 072.2, and U.S. Pat. No. 3,620,167, for example.

Form-locking means for ensuring an immobile connection between the drive cage and the projectile body have, of course, been provided heretofore. Such means can include threads or grooves formed on the exterior of the body of the projectile and engageable by complementary threads or ribs formfitting into them from the sabot. One of the difficulties with this approach, however, has been that the threads or grooves represent indentations in the body of the subcaliber projectile and can form weakened zones or incipient cracks which can spread upon impact and thereby decrease the penetrability of the projectile at the target.

In order to avoid the notching of the body of the projectile, illustrated, for example, in U.S. Pat. No. 3,620,167, the approach described in German application 30 30 072.2 was successfully adopted and utilized an additional element around the projectile body to create the formfitting connection with the sabot and exploit the metallurgical properties of this element and the projectile to immobilize the additional formfitting element on the projectile body. The formfitting element was preferably a one-piece sleeve of light metal such as an aluminum alloy.

While this approach was successful, it nevertheless required a somewhat complex relationship between the formfitting element and the heavy metal projectile body which could not always be obtained in practice.

OBJECTS OF THE INVENTION

It is, therefore, the principal object of the present invention to provide an improved form-locking engagement of the sabot to the body of the projectile whereby disadvantages of prior art arrangements are avoided.

Another object of this invention is to eliminate the notching effect and thereby increase the penetrating effectiveness of a subcaliber inertial projectile while nevertheless obtaining the advantages of subcalilber projectiles firing from a weapon.

It is also an object of this invention to improve the effectiveness of a penetrating projectile by eliminating any effective reduction in the cross section thereof resulting from notching effects for retaining a sabot on the projectile body.

SUMMARY OF THE INVENTION

These objects and others which will become apparent hereinafter are attained, in accordance with the present invention, by providing a support sleeve around the projectile body and closely hugging it which has high strength and when viewed in axial section defines a profile which formfittingly is engaged by the surface of the sabot closely surrounding this sleeve. According to the invention, the sleeve is made up of a succession of elements which overlap in succession and thus define the sleeve. At least some of the formations (grooves or ridges) of the sleeves may be defined between two such elements where they are contiguous with one another and overlap.

According to one feature of the invention, these elements are successive turns of a continuous band which turns overlap in the manner described and which is helically wound upon the projectile body.

In another embodiment of the invention, the individual elements are discrete closed rings which axially overlap the elements and thus are stepped in cross section along an axial plane to allow the overlapping of an outer portion of one element around the inner portion of another such element.

When the elements are tightly fitted around the projectile body, preferably utilizing thermal bonding or metallurgical connection, heat-shrinking or the like, they engage the projectile body tightly and can provide a high-strength sleeve which may be nevertheless comparatively thin and which can take considerable stress without creating a notching effect on the projectile body and while nevertheless retaining the sabot firmly during the application of high kinetic energies to the latter. Since the notching of the main projectile body is completely excluded, especially high target penetrabilities of the projectile can be obtained.

According to a feature of the invention, the sleeve can be composed of hot-formed or cold-formed steel.

The profile may generally have an S shape or a flattened-S shape to provide the inner and outer portions which overlap in the manner described and chamfered (inclined) or curved end faces at one end of each element can cooperate with chamfered or curved end faces at the opposite end of an outer portion of the other element to define a groove of V- or U-configuration into which a complementary rib or ridge of the sabot can fit. The inner portion of one element can fit complementarily into a cavity formed beneath the overhang provided by the outer portion of an adjoining element. The inner surface of the ring or strip can be defined by a hot-forming or cold-forming operation and can formfittingly engage the projectile body and the outer portion of the sleeve can include a groove which is formed by a hot-forming or cold-forming operation applied to the overlapping elements after they have been fitted upon the projectile body.

Preferably the elements are turns of a strip or band which is wound in overlapping turns on the projectile body and has a high L/D (length/diameter) ratio utilizing a hot-forming operation during the application of the strip or band and permitting the strip or band to shrink onto the body. The application of the strip can simplify the formation of the sleeve since it eliminates the need for successively fitting discrete rings with narrow tolerances onto the body of the projectile.

In another case, however, a groove can be applied by an aftertreatment or hot embossing or working operation. Preferably at least in part the strip or rings are applied after having been preformed.

As a result, a secure connection can be provided between the sleeve and the projectile body without separation of fibers of the material of the body and thus without any material notch effect.

When the rings are applied I prefer to use a cold pressing to force them onto the projectile body. This permits firm attachment and eliminates the need for subsequent machining and other efforts in fabricating the sleeve.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 10:
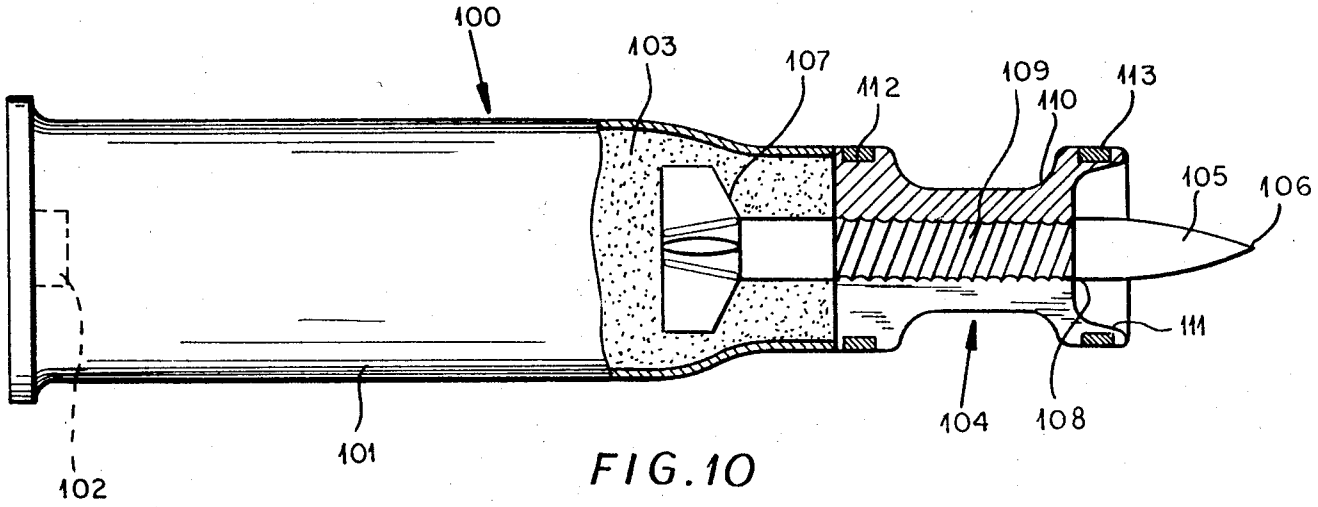
FIG. 10 is a fragmentary sectional view showing a munitions round embodying a projectile having the grooved form-locking means of the present invention.

Referring first to FIG. 10, it can be seen that a munitions round 100 according to the invention can comprise the sheel casing 101 provided with a primer 102 and an explosive charge 103 for propelling a projectile 104 from the cannon in which the round is fired. The projectile 104 comprises a projectile body 105 which may be of the inertial impact type and may be composed in whole or in part of a heavy metal, e.g. tungsten, having a penetrator 106 and a fin stabilizer 107 at the tail of the projectile.

Along the cylindrical central portion 108 of the projectile body, a sleeve 109 may be formed as illustrated in FIGS. 2 through 9 to formfittingly engage a sabot 110 having a pocket 111 adapted to catch the air and to cause the segments of the sabot to separate from one another and the projectile. (See U.S. Pat. No. 3,620,167). The sabot segments are held together by bands 112 and 113 which are frangible by the outward force applied to the sabot segments.

The subcaliber projectile operates in the usual manner, i.e. the round 100 is inserted into the breech of the cannon, the breech is closed and the round is fired. The sabot 110 closely fits the bore of the cannon and thus the propellant gases generated by the explosion of the charge 103 propel the projectile from the mouth of the barrel where the pocket 111 encounters air resistance and the air resistance tears the sabot segments free from the projectile. The latter continues on its flight inertially to the target vehicle which can be a multilayer armor which is penetrated by the inertial body 105.

Figure 1:
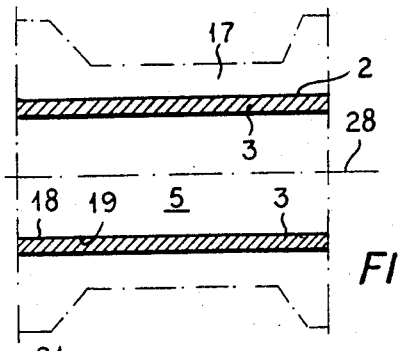
FIG. 1 is an explanatory diagram representing an axial section through a sleeve.

FIG. 1 represents the sleeve 109 at 3, the projectile body being represented at 5 and the projectile axis at 28.

The heavy metal projectile body 5 thus extends along this axis which is surrounded by the sleeve 3 whose cross section is shown solid in FIG. 1 but actually is made up of a series of discrete elements 4 in overlapping relationship. The sabot or drive cage is denoted in dot-dash lines at 17 in FIG. 1.

The overlapping elements differ in FIGS. 2, 3 and 4 and may consist of overlapping turns of a strip as will be described or as overlapping rings. The inner surfaces of these elements have been represented at 16 and form a continuous inner surface 18 which can forcefittingly engage the surface 19 of the projectile body.

Figure 2:
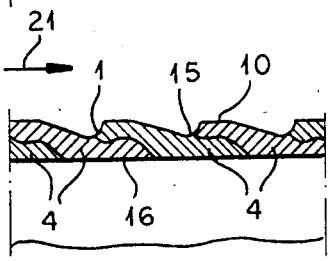
FIG. 2 is an enlarged section of a sleeve showing its formation according to the invention from overlapping elements without especially prefabricating the outer profile with a groove.
Figure 6:
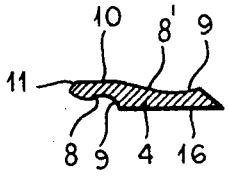
FIG. 6 is a section through the strip used in FIG. 2.
Figure 3:
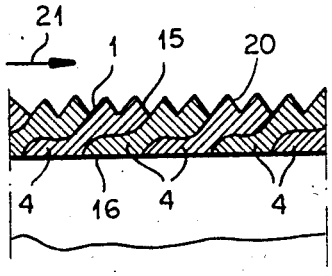
FIG. 3 is a view similar to FIG. 2 but showing a system in which the individual elements have been prefabricated with a V-section groove.
Figure 7:
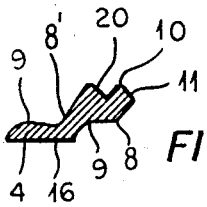
FIG. 7 is a section through a strip similar to that used in FIG. 3.
Figure 4:
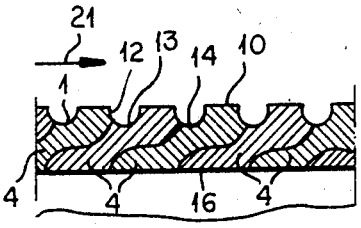
FIG. 4 is another section through a sleeve showing an arrangement of the individual elements whereby they form a U-shaped channel with curved portions.
Figure 8:
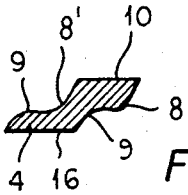
FIG. 8 is a section through a strip which can be used to produce the groove of the embodiment of FIG. 4 utilizing the forming method of FIG. 5.
Figure 5:
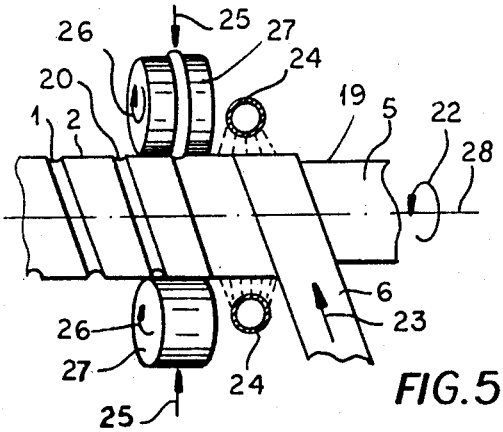
FIG. 5 is a somewhat perspective view showing the application of the strip to a projectile body according to an embodiment of the invention.
Figure 9:
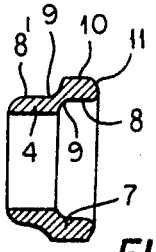
FIG. 9 is a section through a ring which can be similarly grooved after application to the projectile body.

The cross sections of the elements 4 shown in FIGS. 2, 3 and 4 are applicable to a strip 6 applied as described in connection with FIG. 5 or formed as stepped endless rings 7 (FIG. 5). In both cases the element 4 can have the individual configuration shown in FIGS. 6 through 9 and can be generally S-shaped, this profile being represented at 9 and having between the inner and outer ends, axially facing surfaces 8 and 8', the former being an internal surface which represents a cavity in which the inner step of a succeeding element can fit while the latter represents an outer ledge over which the outer step of the preceding element can be applied. The end of the rings and particularly the outer steps (see FIGS. 6 and 7) can be beveled or chamfered at 11 or can be provided with rounds at 12 or 13 (FIG. 4) to define annular or helical channels 14 or 15 which can be V-shaped or U-shaped. Into these grooves or channels, complementary ridges of the sabot can fit so that the acceleration forces in the direction of arrow 21 are transferred effectively to the body of the projectile. For especially high acceleration forces the strip or rings can be composed of hot-formable or cold-formable steel and a hot forming of the strip can be performed as it is wound around the body of the projectile (FIG. 5) or a hot forming can be performed subsequently or either hot or cold forming can be used to apply the rings 7 forcefittingly onto the ring 19 and to shape the grooves therein.

As can be seen from FIG. 5, the projectile can be rotated about its axis 28 as represented by arrow 22 to form a mandrel around which the strip 6 is continuously coiled. A heating element 24, for example, a ring burner, magnetic induction coil or the like, heats the strip to forging temperature so that it is hot formed under tension onto this mandrel. Rolls 27 can press the strip while it is in the forging temperature against the projectile body, these rolls being urged radially (arrow 25) against the strip and the body and being rotated in the senses represented by arrow 26 to ensure the hot forming of the strip under tension around the body. A ridge 27' on one of the rolls 27 can simultaneously form a groove 20 analogous to the groove 14 into the overlapping turns of the strip. Upon cooling the strip shrinks tightly against the body of the projectile without notching or deforming the latter significantly. A similar groove can be provided utilizing rolls 27 when the rings 7 are applied to form the sleeve.

When rings are used instead of a strip, they can be provided with the outer groove formation and locked to one another and to the body of the projectile by a flow passing at forging temperatures or by a cold deformation. The intrinsic inward pressure generated in these rings, therefore, will ensure a high degree of adhesion between the rings and the projectile body.

The adhesion can be improved by maintaining a high degree of roughness at the interface between sleeve and the projectile body and this roughness can be augmented by providing a fine thread or tooth or corrugation formation either along the inner surface of the strip or ring or along the exterior of the body.

The projectile body, to avoid outer boundary layer or ballistic effects, can be either provided with an outer ballistic hood (not shown) or can be somewhat enlarged at the leading end of the projectile. Such effects on the surface 2 of the sleeve 3 will thus not be significant.

Naturally, the hot and cold working of the strip or rings on the projectile body may be effected by any working method which does not result in damage to the projectile body and can include rolling, forming, hammering and swaging.

I claim:

1. A form-locking device composed of metal for securing a sabot to a projectile which comprises a sleeve composed of high-strength elements overlapping in an axial direction, said elements defining an external surface of the sleeve provided with formations formfittingly engaging formations of said sabot, each of said elements having a cross section in an axial plane which is generally S-shaped having an inner portion hugging said projectile and an outer portion spaced from said projectile and overlapping an inner portion of an adjacent element, the inner portions of adjacent elements being flush with one another.

2. The form-locking device defined in claim 1 wherein said elements are successive turns of a strip.

3. The form-locking device defined in claim 1 wherein said elements are individual closed rings.

4. The form-locking device defined in claim 1 wherein said elements are composed of a heat-formable or cold-formable steel and are shaped at least in part on said projectile.

5. The form-locking device defined in claim 1 wherein said elements are preformed with a groove defining said formations of said sleeve prior to application to said projectile.

6. The form-locking device defined in claim 1 wherein the outer portions of adjacent elements are provided with contacting flanks which have portions which project outwardly beyond the regions of contact of said flanks, said portions of said flanks defining grooves between them, said grooves constituting said formations of said sleeve.

7. The form-locking device defined in claim 6 wherein said grooves are generally of V-section.

8. The form-locking device defined in claim 6 wherein said grooves are generally of U-section.

9. A method of making a projetile body having a form-locking device for connection of a sabot to a projectile body, comprising the steps of applying to a generally cylindrical projectile body a succession of elements in overlapping relationship to form a sleeve surrounding said body;

forming said elements on said body to render said elements adherent thereto; and attaching a sabot in form-locking relationship to said elements.

10. A method of making a projetile body having a form-locking device for connection of a sabot to a projectile body, comprising the steps of:

applying to a generally cylindrical projectile body a succession of elements in overlapping relationship to form a sleeve surrounding said body;

forming said elements on said body to render said elements adherent thereto; and attaching a sabot in form-locking relationship to said elements, said elements being applied to said body by coiling a strip with overlapping turns therearound at a temperature sufficient to hot-form said strip on said body.

11. A method of making a projetile body having a form-locking device for connection of a sabot to a projectile body, comprising the steps of:

applying to a generally cylindrical projectile body a succession of elements in overlapping relationship to form a sleeve surrounding said body;

forming said elements on said body to render said elements adherent thereto; and attaching a sabot in form-locking relationship to said elements, said elements being being preformed rings applied to said body and flow-pressed thereagainst to secure said elements to said body.

12. The method defined in claim 9, further comprising hot-pressing a groove into said sleeve to receive a complementary portion of the sabot drive cage.

13. The method defined in claim 9 wherein said elements are applied hot to said body and are permitted to cool to shrinkfit them against said body.

14. A projectile assembly comprising:

an elongated inertial impact projectile comprised at least in part of a heavy metal and formed with a penetrator at one end and a fin-stabilizer at an opposite end;

a form-locking device surrounding a central portion of said projectile; and a sabot formfittingly engaging said device, said device comprising a sleeve composed of high-strength elements overlapping in an axial direction and provided along an exteranl surface of the sleeve with a formation formfittingly engaging a formation of said sabot, each of said elements having a cross section in an axial plane which is generally S-shaped having an inner portion hugging said projectile and an outer portion spaced from said projectile and overlapping an inner portion of an adjacent element, the inner portions of adjacent elements being flush with one another.

15. The projectile assembly defined in claim 14 wherein said elements are successive turns of a strip.

16. The projectile assembly defined in claim 14 wherein said elements are individual closed rings.

17. The projectile assembly defined in claim 14 wherein said elements are composed of a heat-formable or cold-formable steel and are shaped at least in part on said projectile.

18. The projectile assembly defined in claim 14 wherein the outer portions of adjacent elements are provided with contacting flanks which have portions which project outwardly beyond the regions of contact of said flanks, said portions of said flanks defining grooves between them, said grooves constituting said formations of said sleeve.

* * * * *